US006549636B2

(12) United States Patent
Fujimoto et al.

(10) Patent No.: US 6,549,636 B2
(45) Date of Patent: Apr. 15, 2003

(54) MINIATURE MICROPHONE COMPONENT WITH CONDUCTIVE RUBBER CONTACTS

(75) Inventors: Mitsuhiro Fujimoto, Aichi (JP); Hiroshi Nemoto, Aichi (JP)

(73) Assignee: Fuji Polymer Industries Co., Ltd., Nagoya (JP)

( * ) Notice: Subject to any disclaimer, the term of this patent is extended or adjusted under 35 U.S.C. 154(b) by 0 days.

(21) Appl. No.: 09/024,332

(22) Filed: Feb. 17, 1998

(65) Prior Publication Data

US 2001/0010726 A1 Aug. 2, 2001

(30) Foreign Application Priority Data

Mar. 19, 1997 (JP) ..... 9-066389

(51) Int. Cl.[7] ..... H04R 25/00

(52) U.S. Cl. ..... 381/368; 381/355; 381/361; 439/91

(58) Field of Search ..... 381/355, 361, 381/364, 365, 368, 170, 173, 174, FOR 147, FOR 148; 379/431, 432, 443.03, 443.05; 439/500, 856, 86, 91

(56) References Cited

U.S. PATENT DOCUMENTS

| | | | | |
|---|---|---|---|---|
| 3,816,671 A | * | 6/1974 | Fraim et al. | 381/174 |
| 4,209,481 A | | 6/1980 | Kashiro et al. | |
| 4,835,060 A | | 5/1989 | Kosiarski et al. | |
| 5,122,215 A | | 6/1992 | Shibata et al. | |
| 5,443,876 A | | 8/1995 | Koskenmaki et al. | |
| 5,574,794 A | | 11/1996 | Valley | |
| 5,613,011 A | | 3/1997 | Chase et al. | |
| 5,788,516 A | * | 8/1998 | Uggmark | 439/86 |
| 5,923,750 A | * | 7/1999 | Enting | 379/433 |
| 6,217,349 B1 | | 4/2001 | Konno | |
| 6,307,946 B1 | * | 10/2001 | Fujimotot et al. | 381/361 |

FOREIGN PATENT DOCUMENTS

| | | |
|---|---|---|
| WO | WO 95/05715 | 2/1995 |
| WO | WO 95/27323 | 10/1995 |

OTHER PUBLICATIONS

Leonard S. Buchoff, Advanced Non–Soldering Interconnection, Apr. 16, 1991, pp. 248–251.

S. Leonard Spitz, Conductive Polymers Come Out From the Labs, Feb., 1991, pp. 64–68.

European Search Report for EP 98 10 4583, Oct. 19, 1998.

European Search Report for EP 98 11 1105, Oct. 8, 1998.

* cited by examiner

*Primary Examiner*—Huyen Le
(74) *Attorney, Agent, or Firm*—Merchant & Gould P.C.

(57) ABSTRACT

A miniature microphone component comprises a miniature condenser microphone, conductive rubber contacts formed and fixed on a terminal area of the miniature microphone and a rubber casting (also called "bushing") for protection against vibrations covering the circumference of the miniature microphone. To install the miniature microphone component, it is sufficient to insert the miniature microphone component into a small-size communication device so that the conductive rubber contacts formed and fixed on the terminal area of the miniature microphone are pressed against terminal portions on a circuit board. Thus, the working efficiency of the assembly can be considerably increased and the installation space can be minimized.

19 Claims, 3 Drawing Sheets

MINIATURE MICROPHONE COMPONENT WITH CONDUCTIVE RUBBER CONTACTS

FIELD OF THE INVENTION

The present invention relates to a miniature microphone component that is optimized for insertion into the main body of a small-size communication device such as a mobile phone or a mobile radio.

BACKGROUND OF THE INVENTION

At present, the development of ever smaller and lighter small-size portable communication devices is well-established, and thus microphone elements to be used as components of such communication devices are also becoming smaller. For the installation of a miniature microphone in such a communication device, a thin lead wire is soldered to connect the terminals of the miniature-microphone-side to the terminals on a circuit board in the main body of the small-size communication device, and then the miniature microphone is covered with a rubber casting as a seal against vibrations and inserted into the small-size communication device.

However, the process of attaching the miniature microphone by soldering with a thin lead wire leads to the problems that the product quality is not steady, because this process involves a delicate soldering job that has to be performed by hand and hardly can be automatized, and the installation space cannot be made narrower, since the lead wire has to be connected.

In order to overcome these problems of the prior art, it is a purpose of the present invention to provide a miniature microphone component with conductive rubber contacts for an installation method wherein the soldering job is eliminated, thus facilitating the assembly, and the installation space can be made very small.

SUMMARY OF THE INVENTION

In order to achieve the above purpose, a miniature microphone component according to the present invention comprises (electrically) conductive rubber contacts and a rubber casting for protection against vibrations covering the circumference of a miniature microphone. The conductive rubber contacts are formed and fixed on a terminal area of the miniature microphone. The miniature microphone, the rubber casting for protection against vibrations covering the miniature microphone and the conductive rubber contacts are integrated into one component. Due to this configuration, the miniature microphone component according to the present invention can be assembled easily just with pressure contacting it to terminals on a circuit board and the jobs of soldering and connecting a lead wire can be omitted. As a result, the assembly can be facilitated and an installation method for a very small installation space can be used.

It is preferable that the rubber casting for protection against vibrations is made of silicone rubber, because its durability is high and its protection against vibrations is excellent.

From the viewpoint of material mixture, it is preferable that at least one rubber selected from the group consisting of polybutadiene, natural rubber, polyisoprene, SBR (styrene-butadiene rubber), NBR (acrylonitrile-butadiene rubber), EPDM (ethylene-propylene rubber (ternary copolymer)), EPM (ethylene-propylene rubber), polyurethane-polyester-based rubber, chloroprene rubber, epichlorohydrin rubber and silicone rubber is used as a material for the conductive rubber contacts, but considering its electrical properties and weather resistance, silicone rubber is the most preferable. Moreover, to ensure conductivity, it is preferable that the conductive rubber contacts comprise carbon powder. It is preferable that the conductive rubber contacts contains 10–150 weight parts carbon powder per 100 weight parts rubber component, preferably silicone rubber. More preferable are 40–100 weight parts carbon powder. Good conductivity is not attained, when the added amount of carbon powder is below these ranges. When the added amount of carbon powder is above these ranges, the conductivity hardly increases, and the formability and the compression resilience of the conductive rubber contacts are inhibited.

To ensure an even higher conductivity, it is preferable that the conductive rubber contacts comprise at least one powder selected from the group consisting of: a metal powder containing platinum, gold, silver, nickel, cobalt, copper, tin, aluminum or palladium; an alloy powder containing solder; a conductive powder of organic polymer powder that has been coated with a metal; and a conductive powder of inorganic powder that has been coated with a metal. Such a powder can be added in addition to the carbon powder or in place of the carbon powder. It is preferable that the conductive rubber contacts contain 1–400 weight parts powder per 100 weight parts rubber component, preferably silicone rubber. More preferable are 100–300 weight parts. Better conductivity is not attained when the added amount of powder is below these ranges. When the added amount of the powder is above these ranges, the conductivity hardly increases, and the formability and compression resilience of the conductive rubber contacts are inhibited.

The volume resistivity of the conductive rubber contacts should be in the range between $10^{-4}$ Ω cm and $10^{2}$ Ω cm. More preferable is a volume resistivity between $10^{-3}$ Ω cm and 10 Ω Q cm. It is not useful to employ a volume resistivity below these ranges, because then the material costs are high and the rubber resilience is low. If the volume resistivity is above these ranges, the attained conductivity is not suitable and may be unsatisfactory.

It is preferable that the conductive rubber contacts are elastically compressible and can be area-contacted under pressure-induced elastic deformation of the conductive rubber contacts to a terminal portion on a circuit board. With such a configuration, the conductive rubber contacts deform elastically when contacted with the terminals of a circuit board, so that the reliability of the electrical contact is increased. Furthermore, because the miniature microphone is clamped and retained by the conductive rubber contacts and the rubber casting against vibrations, its resistance against vibrations is increased. It is preferable that the conductive rubber contacts have a compression resilience of 30–80 measured with Method A in JIS K6301. If the compression resilience is below this range, the elastic deformation of the conductive rubber contacts becomes large, and the conductivity becomes pressure sensitive, so that the electric contact resistance to the terminals of the circuit board becomes unstable. If the compression resilience is above this range, the elastic deformation of the conductive rubber contacts becomes small, so that the reliability of the electric contact to the terminals of the circuit board decreases. Method A in JIS K6301 for measurement of the compression resilience is performed as follows: A sample piece of the size specified in JIS K6301 is prepared from the material to be tested. An A-type spring-based hardness meter according to JIS K6301 is used as measuring instrument. Method A in JIS K6301 is in conformity with Type A in ASTM D2240.

In the above miniature microphone component with conductive rubber contacts, a highly reliable electrical planar contact can be established just by slightly compressing the conductive rubber contacts, which are formed and fixed to the terminal area of the miniature microphone, between the terminal areas on the circuit board inside the small-size communication device and the terminal area of the miniature microphone. Soldering of a lead wire to establish contact with a circuit board becomes obsolete. Thus, not only can the installation space be made much smaller, but a troublesome installation job can be eliminated.

In addition, the rubber casting (also called "bushing" in the following) for protection against vibrations is shaped so that it can hermetically cover the miniature microphone completely, except for the terminal area and a sound-collecting portion. This rubber casting can be integrated with the miniature microphone and the conductive rubber contacts, so that the miniature microphone component with conductive rubber contacts can be installed just by inserting it into a predetermined location inside a small-size communication device, which considerably increases the working efficiency of the assembly.

The use of the rubber casting (bushing) as a protection against vibrations of course enhances the reliability of the miniature microphone under vibrations, and when the miniature microphone component is built into a small-size communication device, the pressure between the conductive rubber contacts formed and fixed on the microphone terminal area and the circuit board terminal area is held constant due to the rubber resilience of the bushing. Thus, the additional effect of an electric contact with high reliability is achieved.

The miniature microphone component according to the present invention can be used for all kinds of applications, but it is preferable that it is used to be inserted into a miniature portable communication device such as a mobile phone. The miniature microphone component according to the present invention can be assembled without soldering a lead wire to it, so that the installation space can be minimized. Electrical reliability and vibration resistance can be increased simultaneously, because the miniature microphone is clamped in and retained by the conductive rubber contacts and the rubber casting against vibrations. This can add to the product value of small-size portable communication devices, for which an increase of miniaturization and reliability is especially desirable.

As has been pointed out above, in a miniature microphone component with conductive rubber contacts according to the present invention, a highly reliable electrical contact can be established just by slightly compressing the conductive rubber contacts, which are formed and fixed to the miniature microphone terminal area, between the terminal areas on the circuit board inside the small-size communication device and the terminal area of the miniature microphone. Soldering of a lead wire to establish contact with a circuit board becomes obsolete. Thus, not only can the installation space be made much smaller, but a troublesome installation job can be eliminated.

In addition, the rubber casting (bushing) for protection against vibrations is shaped so that it can hermetically cover the entire miniature microphone except for the terminal area and a sound-collecting portion. This rubber casting can be integrated with the miniature microphone and the conductive rubber contacts, so that the miniature microphone component with conductive rubber contacts can be installed just by inserting it into a predetermined location inside the small-size communication device, which considerably increases the working efficiency of the assembly. The use of the bushing as a protection against vibrations enhances of course the reliability of the miniature microphone under vibrations, and when the miniature microphone component is built into a small-size communication device, the pressure between the microphone terminal area and the circuit board terminal area is held constant due to the rubber resilience of the bushing. Thus, the additional effect of an electric contact with high reliability is achieved.

DESCRIPTION OF THE PREFERRED EMBODIMENTS

In the following, the present invention is described more specifically with examples. However, the present invention is by no means limited to these examples.

Figure 1:
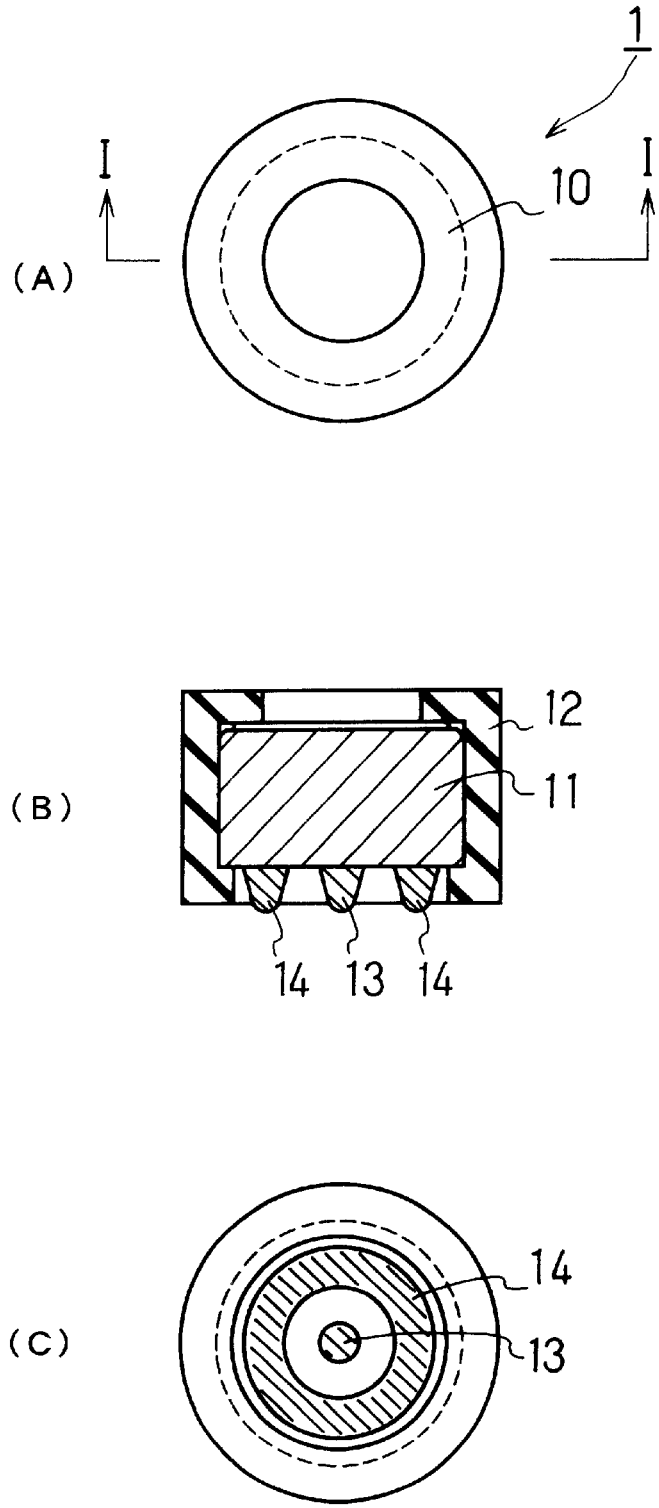
FIG. 1A shows a top view of a miniature microphone component according to a first example of the present invention.
FIG. 1B shows a sectional view along I—I in FIG. 1A.
FIG. 1C shows a bottom view of the same example.

In a first example as shown in FIG. 1A (top view), FIG. 1B (sectional view along I—I in FIG. 1A) and FIG. 1C (bottom view), a miniature microphone component 1 comprises a miniature condenser microphone 11, conductive rubber contacts 13, 14 and a rubber casting 12 (also called a "bushing") for protection against vibrations. The size of the miniature microphone component 1 is 6–10 mm in diameter and 2–4 mm in height. The thickness of the rubber casting 12 for protection against vibrations is about 0.9 mm. The conductive rubber contacts 13 and 14 have a diameter and a width respectively of 1.5 mm at a base portion that is affixed to the miniature condenser microphone 11, and a height of 1.5 mm.

As becomes clear from FIG. 1C (bottom view), the conductive rubber contacts 13 and 14 are arranged on the terminal area side as two concentric circles (one protruding terminal portion 13 in the center and another, donut-shaped protruding terminal portion 14 arranged at a distance around it). The conductive rubber contacts 13 and 14 are self-adhesively formed and fixed by casting a not-yet-hardened conductive rubber compound into a predetermined form on the terminal area of the miniature condenser microphone 11, and then hardening the compound.

Figure 2:
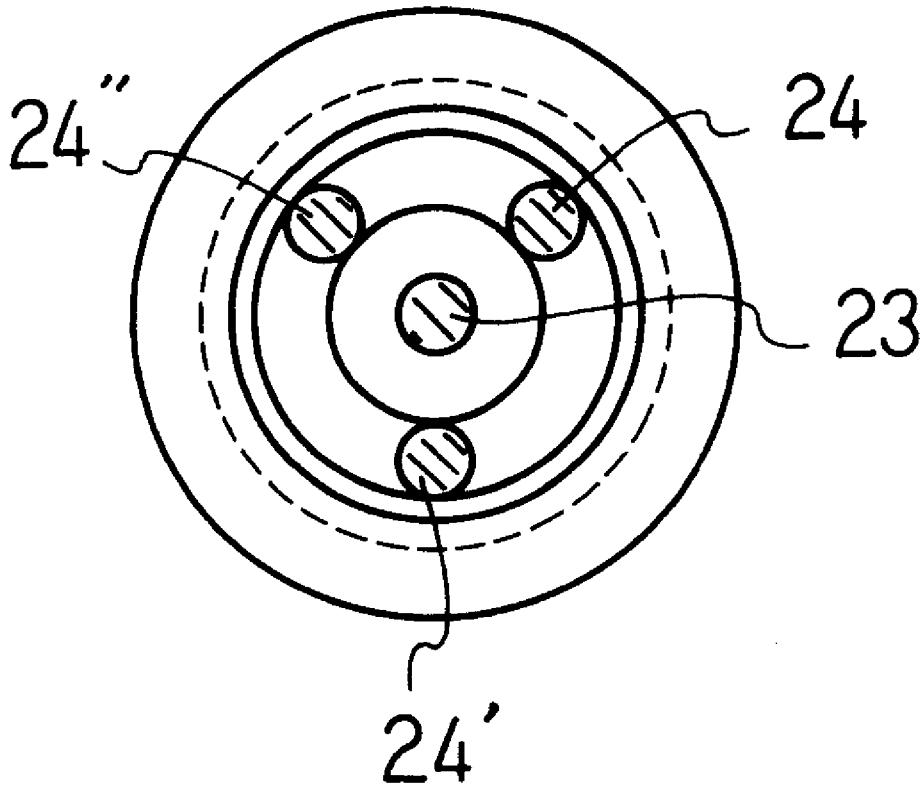
FIG. 2 shows a bottom view of a miniature microphone component according to another example of the present invention.

As can be seen from FIG. 2, which shows another example, one terminal portion 23 protrudes from the center and three terminal portions 24, 24' and 24" are arranged on a concentric circle around the center on the terminal area of a miniature condenser microphone. In this example the conductive rubber contacts are formed and attached on portions of the outer terminal and completely on the inner terminal.

Figure 3:
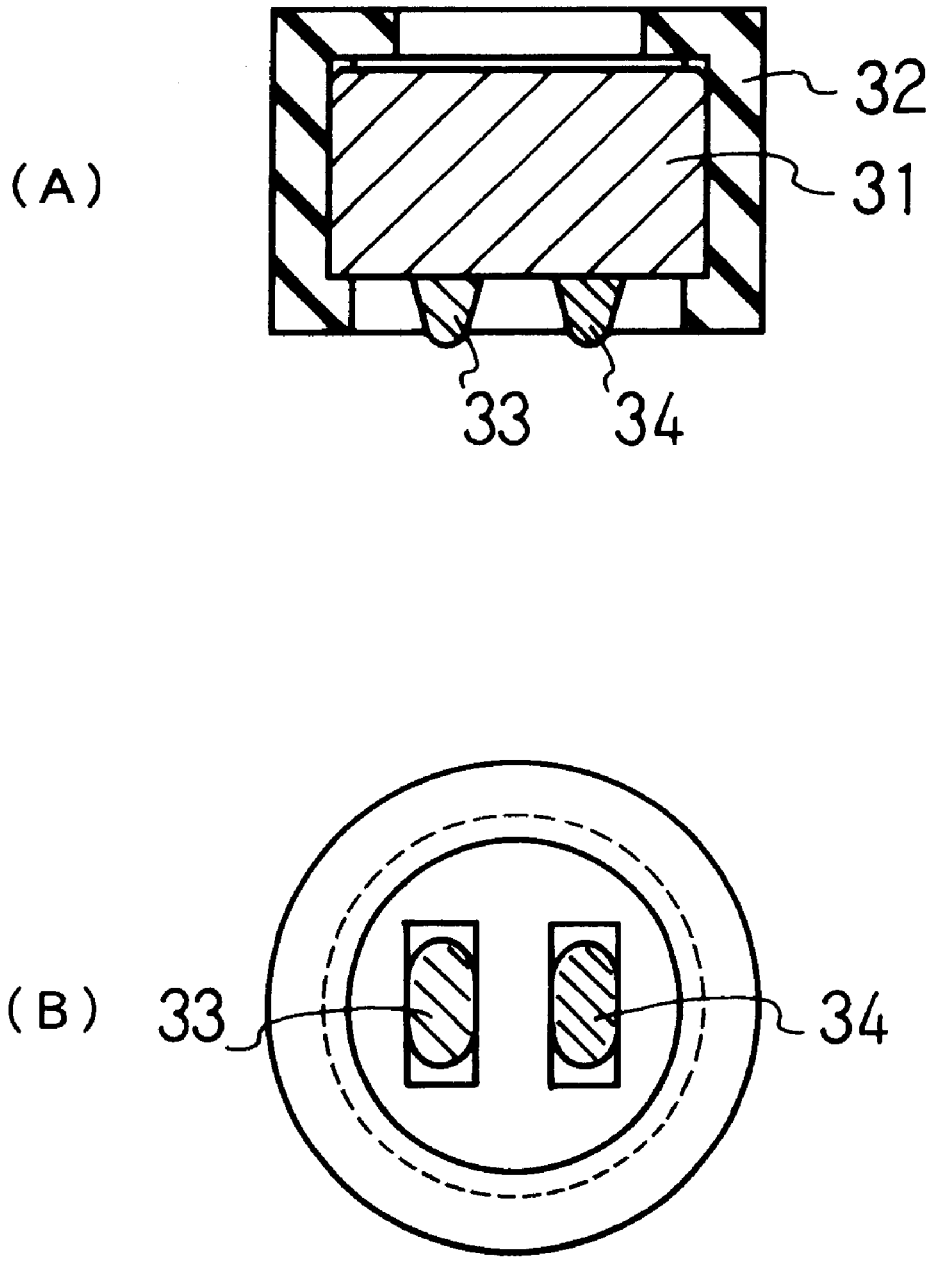
FIG. 3A shows a sectional view of a miniature microphone component according to yet another example of the present invention.
FIG. 3B shows a bottom view of the same example.

FIGS. 3A and B show yet another example of the present invention. In this example, conductive rubber contacts 33 and 34 are formed and fixed on two terminal areas of a miniature condenser microphone with two equally shaped terminals. Numeral 31 indicates a miniature condenser microphone and numeral 32 indicates a rubber casting (bushing) for the protection against vibrations.

A conductive silicone rubber such as "Fujipoly 7 HGA" (product of Fuji Polymer Ind. Corp.), which includes 300 weight parts of metal powder as a conductive powder mixed with 100 weight parts rubber component, "Fujipoly 6KB" (product of Fuji Polymer Ind. Corp.), which includes 80 weight parts of carbon powder as a conductive powder mixed with 100 weight parts rubber component, or products such as "KE3491/KE3492/KE4576" (product of Shin-Etsu Chemical Corp.) or "SLM77124" (product of Wacker-Chemie GmbH) can be used as the conductive rubber contacts of these examples. The volume resistivity of the conductive rubber contacts used in these examples was $10^{-3}$ Ω cm, and the compression resilience according to Method A of JIS K6301 was 60.

A silicone rubber casting such as "Fujipoly M Mould 4EC Bushing" (product of Fuji Polymer Ind. Corp.) that is shaped so that it can hermetically cover the entire miniature microphone except for the terminal area and a sound-collecting portion can be used as a rubber casting (bushing) for protection against vibrations.

To install the miniature microphone component, it is sufficient to insert the miniature microphone component into a small-size communication device so that the conductive rubber contacts formed and fixed on the terminal area of the miniature microphone are pressed against the terminal portions on the circuit board. Thus, the working efficiency of the assembly can be increased considerably, the installation space can be minimized and an electrical connection with high reliability is possible.

Possible materials that can be used for the conductive rubber contacts include a conductive rubber into which carbon powder has been mixed, a conductive rubber into which a metal powder such as platinum, gold, silver, nickel, cobalt, copper, tin, aluminium or palladium has been mixed, a conductive rubber into which an alloy powder such as solder has been mixed, and a conductive rubber into which an organic polymer powder that has been coated with a metal or an inorganic powder that has been coated with a metal has been mixed.

Possible materials to be used for the conductive rubber include polybutadiene, natural rubber, polyisoprene, SBR, NBR, EPDM, EPM, polyurethane-polyester-based rubber, chloroprene rubber, epichlorohydrin rubber and silicone rubber, but considering its electrical properties and weather resistance, silicone rubber is the most preferable.

The invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description, all changes that come within the meaning and range of equivalency of the claims are intended to be embraced therein.

What is claimed is:

1. A miniature microphone component comprising conductive rubber contacts and a cylindrical rubber casting for protection against vibrations surrounding the circumference of a miniature microphone having a terminal area and a sound-collecting portion, the rubber casting is shaped to hermetically cover to miniature microphone, except for the terminal area and the sound-collecting portion, wherein the conductive rubber contacts are self-adhesively formed and fixed by casting a not-yet-hardened conductive rubber compound into a predetermined form on the terminal area of the miniature microphone, and then hardening the compound on the terminal area of the miniature microphone, and the rubber contacts project beyond an outer surface of the rubber casting, the conductive rubber contacts are integrated into the terminal area of the miniature microphone, and the conductive rubber contacts are elastically compressible and configured so as to be area-contacted under pressure-induced elastic deformation with a terminal portion on a circuit board.

2. The miniature microphone component according to claim 1, wherein the rubber casting for protection against vibrations is made of silicone rubber.

3. The miniature microphone component according to claim 1, wherein the conductive rubber contacts comprise at least one rubber selected from the group consisting of polybutadiene, natural rubber, polyisoprene, SBR, NBR, EPDM, EPM, polyurethane-polyester-based rubber, chloroprene rubber, epichlorohydrin rubber and silicone rubber.

4. The miniature microphone component according to claim 1, wherein the conductive rubber contacts are made of silicone rubber.

5. The miniature microphone component according to claim 1, wherein the conductive rubber contacts comprise carbon powder.

6. The miniature microphone component according to claim 5, wherein the conductive rubber contacts contain 10–150 weight parts carbon powder per 100 weight parts rubber component.

7. The miniature microphone component according to claim 1, wherein the conductive rubber contacts comprise at least one powder selected from the group consisting of a metal powder containing platinum, gold, silver, nickel, cobalt, copper, tin, aluminum or palladium; an alloy powder containing solder; a conductive powder of organic polymer powder that has been coated with a metal; and a conductive powder of inorganic powder that has been coated with a metal.

8. The miniature microphone component according to claim 7, wherein the conductive rubber contacts contain 1–400 weight parts powder per 100 weight parts rubber component.

9. The miniature microphone component according to claim 1, wherein the conductive rubber contacts have a volume resistivity of $10^{-4}$ Ω cm-$10^{2}$ Ω cm.

10. The miniature microphone component according to claim 1, wherein the conductive rubber contacts have a compression resilience of 30–80 measured with Method A in JIS K6301.

11. The miniature microphone component according to claim 1, built into a small-size portable communication device.

12. The miniature microphone component according to claim 11, wherein the small-size portable communication device is a mobile phone.

13. The miniature microphone component of claim 1, wherein said contacts have a width dimension at base portions thereof fixed to the terminal area, and a height dimension, and said width dimension is substantially equal to said height dimension.

14. A miniature microphone component, comprising:

a microphone having a first end surface, a second end surface, a perimeter surface extending between the first and second end surfaces, and a terminal area on one of the first and second end surfaces;

conductive rubber contacts self-adhesively formed and fixed by casting a not-yet-hardened conductive rubber compound into a predetermined form on the terminal area of the miniature microphone, and then hardening the compound on the terminal area;

a cylindrical rubber bashing surrounding the perimeter surface of the microphone, the rubber bushing including a first flange that is disposed over and at least partially covers the first end surface of the microphone, and a second flange that is disposed over and at least partially covers the second end surface of the microphone;

wherein said contacts are integrated into the terminal area of the microphone and project beyond an outer surface of the rubber bushing; and the conductive rubber contacts are elastically compressible and configured so as to be area-contacted under pressure-induced elastic deformation with a terminal portion on a circuit board.

15. The miniature microphone component of claim 14, wherein said terminal area is on said first end surface, and wherein an area of said first end surface covered by said first flange is less than an area of said second end surface covered by said second flange.

16. The miniature microphone component of claim 14, wherein one of said flanges projects further toward a center of the respective said end surface than the other said flange.

17. The miniature microphone component of claim 14, wherein the thickness of said first flange is substantially equal to the thickness of said second flange.

18. The miniature microphone component of claim 17, wherein the cylindrical rubber bushing surrounding the perimeter surface of the microphone includes a thickness that is substantially equal to the thickness of said first and second flanges.

19. The miniature microphone component of claim 14, wherein said contacts have a width dimension at base portions thereof fixed to the terminal area, and a height dimension, and said width dimension is substantially equal to said height dimension.

* * * * *